United States Patent [19]

Benbow et al.

[11] Patent Number: 4,982,135

[45] Date of Patent: Jan. 1, 1991

[54] ELECTROLUMINESCENT DEVICE

[75] Inventors: Henry A. Benbow, Wokingham; Ian G. Gibb, Middlesex; John G. Holden, Hertfordshire, all of England

[73] Assignee: Thorn EMI plc, London, England

[21] Appl. No.: 273,542

[22] Filed: Nov. 21, 1988

[30] Foreign Application Priority Data

Nov. 21, 1987 [GB] United Kingdom ..... 8727326

[51] Int. Cl.[5] ..... H05B 33/10; H05B 33/14; H05B 33/22

[52] U.S. Cl. ..... 313/503; 313/506; 313/509; 427/66

[58] Field of Search ..... 313/503, 506, 509; 427/66; 437/127, 128, 904, 905, 906

[56] References Cited

U.S. PATENT DOCUMENTS

| | | | |
|---|---|---|---|
| 4,137,481 | 1/1979 | Hilsum et al. | 313/503 |
| 4,140,937 | 2/1979 | Vecht et al. | 313/503 |
| 4,365,184 | 12/1982 | Higton et al. | 313/503 |
| 4,758,765 | 7/1988 | Mitsumori | 313/503 X |

FOREIGN PATENT DOCUMENTS

| | | |
|---|---|---|
| 0137850 | 4/1985 | European Pat. Off. . |
| 0159531 | 10/1985 | European Pat. Off. . |
| 800581 | 1/1951 | United Kingdom . |
| 735239 | 11/1952 | United Kingdom . |
| 782096 | 2/1954 | United Kingdom . |
| 1296283 | 10/1970 | United Kingdom . |
| 1568111 | 7/1975 | United Kingdom . |
| 1543233 | 8/1976 | United Kingdom . |
| 2143991 | 2/1985 | United Kingdom . |

OTHER PUBLICATIONS

"The Influence of the Method of Deposition on the Microstructure and Optical Properties of Junctions of ZnSe with Indium Tin Oxide"; Electronics and Optics; A. Saidane and D. L. Kirk; 4/1986; pp. 49–67.

"Physics of Semiconductor Devices"; John Wiley & Sons; p. 66; S. M. Sze, 12/1981.

*Primary Examiner*—Kenneth Wieder

*Attorney, Agent, or Firm*—Fleit, Jacobson, Cohn, Price, Holman & Stern

[57] ABSTRACT

An electroluminescent device comprises a film containing a phosphor. Means for causing movement of electrons in the film comprising a first layer on one side of the film and a second layer on the other side of the film are provided. The film includes a first material which is also present in the first layer. It has been noted that such a device has enhanced luminescence as compared to a conventional electroluminescent device.

13 Claims, 2 Drawing Sheets

ELECTROLUMINESCENT DEVICE

The present invention relates to electroluminescent devices.

As shown schematically in FIG. 1, a conventional directly-coupled electroluminescent display panel has a transparent front face 1 behind which there are layers of a transparent electrode 2 (typically cadmium stannate), a phosphor 4 (typically manganese-doped zinc sulphide), a control resistor 6 (typically cermet or α-silicon) and another electrode 8 which need not be transparent (typically aluminium). The complete device is commonly encapsulated to protect the device layers from physical or chemical damage.

The application of a voltage to the electrodes of the device induces a flow of electrons from one electrode to the other via the phosphor layer 4 and the control resistor 6. In directly coupled electroluminescent devices it is usual for the voltage to be applied such that the transparent electrode 2 acts as a cathode while the second electrode 8 forms the anode; electrons thus flow from the transparent electrode 2 through the phosphor and control layers 4, 6 to the second electrode 8. Interaction of these electrons with the phosphor causes light to be emitted.

Under normal operating conditions, there is an abrupt change in chemical composition between the transparent electrode 2 and the phosphor layer 4, i.e. there is little diffusion of material, such as cadmium, from the transparent electrode 2 to the phosphor layer 4 and of material, such as zinc sulphide, from the phosphor layer 4 to the transparent electrode 2. As a result of this, it is widely believed that electrons from the transparent electrode 2 need to overcome a form of 'energy barrier' to pass into the phosphor layer 4 and cause electroluminescence. Thus, in order to produce an adequately-bright image using such a panel, it is necessary to generate a large electric field, typically of the order of 1 $MVcm^{-1}$, across the phosphor layer. This tends to cause degradation and break-down of the materials in the panel. Accordingly, electroluminescent panels which provide a display of acceptable brightness are unreliable in operation and tend to malfunction.

An object of the present invention is to provide an electroluminescent display which overcomes the above-described disadvantages.

According to a first aspect of the present invention there is provided an electroluminescent device comprising a film containing a phosphor and means for causing movement of electrons in said film, said means comprising a first layer on one side of said film and a second layer on the other side of said film wherein said film includes a first material which is also present in said first layer.

It has been noted that such a display device has enhanced electroluminescence as compared to a conventional display device. Preferably the concentration of said first material decreases with distance from said first layer. In this way, the present invention provides a chemically-graded interface for the phosphor, which promotes the action of the electrical field caused when a voltage is applied to the electrode.

Preferably said film comprises a phosphor layer and an interface region between said first layer and the phosphor layer, the interface region comprising said first material and a second material which is also present in the phosphor layer. A device having a distinct phosphor layer is more efficient than one containing no distinct phosphor layer.

In a form of the present invention relating to capacitively-coupled electroluminescent device, said first layer comprises a dielectric layer adjacent said film and an electrode layer and the interface region comprises materials which are also present in the phosphor layer or in the dielectric layer.

In a form of the present invention relating to directly-coupled electroluminescent devices, said first layer comprises an electrode layer and the interface region comprises materials which are also present in the electrode layer or the phosphor layer. The enhanced luminescence of such a device compared to a conventional device is believed to be due to a reduction in the height of the energy barrier between the two media which promotes the transfer of electrons from the electrode layer to the phosphor film with a concomitant increase in device efficiency.

In one advantageous embodiment, a directly-coupled electroluminescent display device comprises a layer of cadmium stannate, a layer of manganese-doped zinc sulphide, and an interface region of manganese-doped zinc/cadmium sulphide. The proportion of cadmium in the interface region may decrease with increasing distance from the electrode layer, and hence provide a chemically-graded interface.

According to a second aspect of the present invention there is provided a method of manufacturing an electroluminescent display device, the method comprising the steps of providing a film comprising a phosphor and a first material, and means for causing movement of electrons in said film, said means comprising a first layer on one side of said film and a second layer on the other side of said film wherein said first material is also present in said first layer.

Preferably the step of providing said film comprises the step of providing a phosphor layer and effecting diffusion between the phosphor layer and said first layer.

In this way, the method provides a chemically-graded interface for the phosphor, which promotes the action of the electric field caused when a voltage is applied to the electrodes of a device made according to this method.

In one form, relating to the manufacture of a capacitively-coupled electroluminescent device, the method comprises effecting diffusion between the phosphor layer and a dielectric layer located between the phosphor layer and an electrode layer.

In another form, relating to the manufacture of a directly-coupled electroluminescent device, the method comprises effecting diffusion between the phosphor layer and an electrode layer.

Diffusion may be effected by the application of heat or preferably by utilising a catalyst to promote formation of the interface layer. The electrode layer may be treated in a wet chemical step with a solution of the catalyst, prior to application of the phosphor layer. Alternatively, the catalyst may be formed as a discrete layer on the electrode layer and then incorporated into the electrode layer, for example by heating, prior to application of the phosphor layer. In an alternative process, the catalyst may be incorporated into the electrode layer by direct methods, for example ion implantation.

In one advantageous embodiment, incorporating a cadmium stannate electrode and a manganese-doped zinc sulphide phosphor, the catalyst comprises chromium and/or chromium oxide.

Other materials which may be suitable as a catalyst according to the present invention may include transition metals, for example Ti, V, Mn, Fe, Co, Ni and Cu. Other electrode/phosphor combinations may be suitable for the present invention, and for example may include indium-tin oxide (ITO) as the electrode material.

In order that the invention may more readily be understood, a description of specific embodiments is now given, by way of example only, and with reference to the accompanying drawings (which are not to scale) in which.

Figure 1:
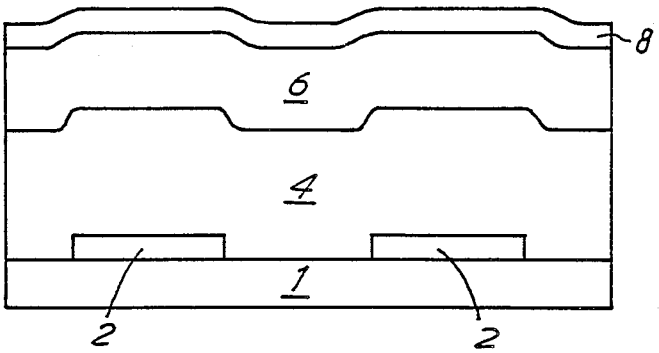
FIG.1 (PRIOR ART)
FIG. 1 shows a schematic representation of a known directly-coupled electroluminescent device.
Figure 2:
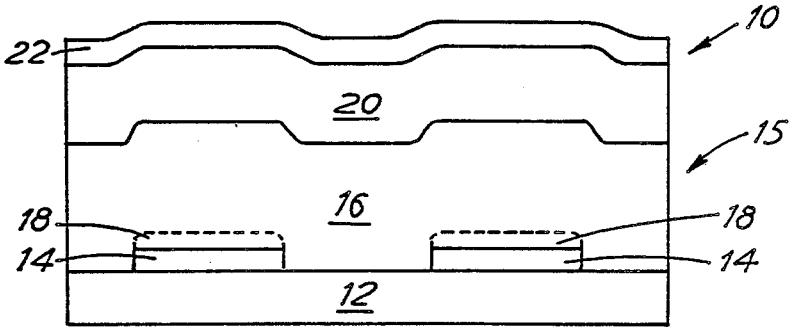
FIG. 2 shows a schematic representation of a directly-coupled electroluminescent device provided in accordance with said first aspect of the present invention; and FIG. *3a*–FIG. *3d* show schematically a method of making a directly-coupled electroluminescent device in accordance with said second aspect of the present invention.

FIG. 2 shows a section through a directly-coupled electroluminescent device 10 provided in accordance with the present invention. The device has a transparent glass front face 12 on which is deposited layers 14 of cadmium stannate forming transparent electrodes of thickness about 0.3 μm. Adjacent the electrodes 14 is a film 15 containing a phosphor and cadmium which is also present in the electrode layers 14. The film 15 comprises a phosphor layer 16 and a distinct interface region 18 intermediate the electrode layers 14 and the phosphor layer 16. The phosphor layer 16 of thickness about 0.8 μm is formed of zinc sulphide doped with manganese. The distinct interface region 18 comprises a solid solution of zinc/cadmium sulphide (manganese). The cadmium is also present in the electrode layer 14 and the zinc sulphide (manganese) is also present in the phosphor layer 16. The electroluminescent device 10 further comprises a control layer 20 of α-silicon of thickness about 0.8 μm and a second electrode layer 22 of aluminium of thickness about 0.2 μm. Movement of electrons in the phosphor layer 16 to produce luminescence is caused by application of a voltage to the electrode layers 14, 22 on either side of the phosphor layer 16.

The formation of the distinct interface region 18 can be achieved by a number of methods.

In a first method, layers are deposited onto a substrate, the composition of the deposited layers being gradually altered from that of the transparent electrode to that of the phosphor layer as the deposition of material is taking place. For materials of composition as different as cadmium stannate and zinc sulphide doped with manganese, this method would require deposition from separate source materials to be performed simultaneously while the relative amounts of each substance in the as-deposited layer is continuously varied. This method accordingly has the disadvantages that such depositions would require elaborate (and expensive) equipment, would be difficult to reproduce accurately and could lead to problems at a later stage of device processing e.g. if the transparent electrode was required to be etched into a number of electrode strips to form the basis of a display matrix.

In a second method, the phosphor layer is deposited directly onto the transparent electrode. Diffusion of chemical species between the phosphor layer and the transparent electrode to form an interface region containing materials from both layers is then induced by the application of heat. The degree of diffusion (and hence the chemical grading) is strongly influenced by the maximum temperature to which the part-fabricated device can be raised before the device substrate melts or species (e.g. sodium) detrimental to the performance of the completed device diffuse between the different layers of the device, including the device substrate.

In a third and preferred method, the formation of a chemically graded interface between the transparent electrode and the phosphor layer involves the use of a catalyst (provided at the interface of the transparent electrode and the phosphor layer e.g. on a surface of the transparent electrode) to promote chemical mixing within the interface region. The role of the catalyst is to reduce the temperature required for incorporation of cadmium into the phosphor layer so that exchange of cadmium and zinc occurs during deposition of the phosphor and in any subsequent post-deposition annealing without the need for an elevated temperature.

An embodiment of the third method for manufacturing a directly-coupled electroluminescent device is described with reference to FIG. 3 of the accompanying drawings.

FIG. *3a* shows a glass substrate 30 onto which a layer 32 of cadmium stannate of thickness about 0.3 μm has been deposited to form one or more transparent electrodes. The cadmium stannate is deposited at a temperature of about 200° C. in an oxygen environment. Chromium/chromium oxide 34 is then incorporated onto the layer 32 and the whole is photoetched (as shown) to produce distinct electrodes if necessary. A phosphor layer 36 of zinc sulphide doped manganese of thickness about 0.8 μm is then applied, as shown in FIG. *3b*, by an appropriate sputtering technique. In the next step, the part-fabricated device is annealed at a temperature of about 450° C. in argon. During the deposition of the phosphor film 36 and the subsequent annealing operation, the chromium/chromium oxide in the cadmium stannate layer 32 catalyses production, by diffusion, of a zinc/cadmium sulphide (manganese) solid solution at the interface between the electrode layer 32 and the phosphor layer 36. The result is the formation of a film 37 containing the phosphor and cadmium from the electrode layer 32. This film 37 comprises the phosphor layer 36 and a distinct diffusion layer 38, as shown in FIG. *3c*, intermediate the cadmium stannate layer 32 which constitutes the electrode and the zinc sulphide (manganese) layer 36 which constitutes the phosphor.

In this example, cadmium from the transparent electrode 32 and zinc from the phosphor layer 36 are exchanged in such a way that the part of the phosphor layer nearest the transparent electrode 32 experiences the greatest exchange of zinc and cadmium, the degree of exchanging gradually decreasing with distance away from the transparent electrode 32 until at a certain distance no cadmium is present in the phosphor. This results in the formation of a distinct interface between the transparent electrode and the phosphor layer in which the cadmium content decreased and zinc content increased with distance from the transparent electrode into the phosphor layer. By appropriate selection of the materials characteristics and operating parameters, it is possible to provide diffusion throughout the entire phosphor film. However, it is preferable to have a distinct layer 36 of zinc sulphide doped with manganese as this is a more efficient phosphor than zinc/cadmium sulphide doped with maganese.

Figure 3A:
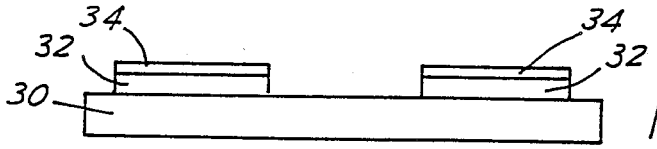
Figure 3B:
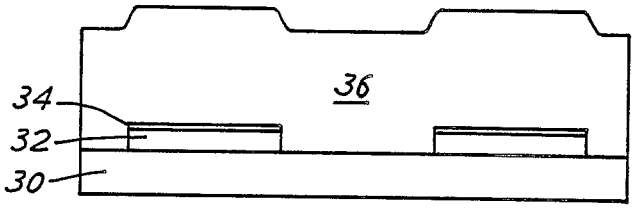
Figure 3C:
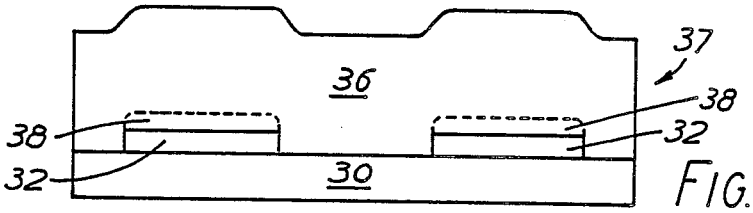
Figure 3D:
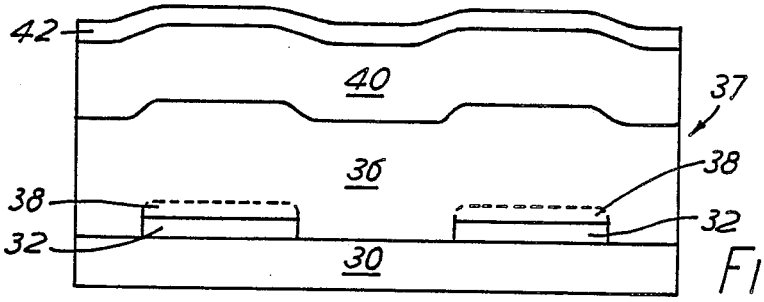

Finally, as shown in FIG. 3*d*, a suitable control layer 40 of e.g. α-silicon of thickness about 0.8 μm and a second electrode layer 42 of e.g. aluminium of thickness about 0.2 μm are deposited. The second electrode layer 42 can be photoetched, if necessary, to produce distinct electrodes.

The chromium/chromium oxide catalyst can be incorporated onto the cadmium stannate in a variety of ways, such as by deposition, ion implantation or wet chemical treatment.

In a deposition step, a layer of chromium and/or chromium oxide of thickness less than 0.1 μm is deposited onto the cadmium stannate layer in an argon environment or in vacuum. Subsequent heat treatment at between about 100° C. and about 750° C. can be utilized.

Ion implantation of chromium/chromium oxide can also be followed by heat treatment at between about 100° C. and about 750° C.

In a wet chemical step, the cadmium stannate layer is treated with a solution containing chromium and/or chromium oxide, e.g. an aqueous solution of concentration from 1 to 10000 ppm chromium. Heat treatment at between about 100° C. and about 750° C. can be subsequently applied. In this way, either the cadmium stannate layer is impregnated with chromium/chromium oxide or a surface coating of chromium/chromium oxide is produced on the cadmium stannate layer.

In a comparative test, one part of a cadmium stannate layer on a borosilicate substrate was doped with chromium/chromium oxide, while another part of the layer remained undoped. The phosphor layer was applied to both parts of the cadmium stannate layer to form a directly-coupled electroluminescent panel with two distinct sections, and then measurements were made of respective light output from the two sections for a variety of operating voltages, the results being summarised in Table 1. It was evident, even from a visual inspection of the relative output from the two sections, that the section with the solid solution (i.e. that section which had been associated with the chromium-doped electrode) was substantially brighter than the other section.

TABLE 1

| OPERATING VOLTAGE (V) | BRIGHTNESS (FtL) With Solid Solution | BRIGHTNESS (FtL) Without Solid Solution |
|---|---|---|
| 130 | 0.41 | — |
| 135 | 1.10 | — |
| 140 | 4.10 | — |
| 145 | 13.00 | 0.19 |
| 150 | 32.00 | 0.48 |
| 155 | 62.00 | 0.96 |
| 160 | 96.00 | 1.45 |

It can readily be seen from Table 1 that, in order to exhibit a brightness of the order of 1FtL, an electroluminescent display device containing the diffusion layer constituted by the solid solution has an electric field satisfied by a potential difference of 135 Volts, whereas a conventional electroluminescent display device without such diffusion layer would need to operate at an electric field obtained by a potential difference greater than 155 Volts. Provision of a lower electric field operation ensures that an electroluminescent display device is less prone to destructive breakdown and hence is more stable; moreover, such provision may enable the display device to utilize cheaper drive electronics.

It is believed that the formation of a diffusion layer constituted by the solid solution results in enhanced electroluminescence because it lowers the magnitude of the electric field necessary to effect injection of electrons from the cadmium stannate electrode into the manganese-doped zinc sulphide phosphor, and thereby promotes the occurrence of this effect.

The present invention is also applicable to the manufacture of a capacitively-coupled electroluminescent device. In such devices, additional dielectric layers are located in between the phosphor and the electrode layers. Movement of electrons in the phosphor layer of such a device to produce luminescence is caused by application of a voltage to the combination of the dielectric layer and the electrode layer on each side of the phosphor layer. According to the present invention, an interface layer is provided comprising diffusion materials from the phosphor and the dielectric layers.

The present invention includes the provision of an interface layer by diffusion between the phosphor and either, or both, electrode layers or dielectric layers in an electroluminescent device, with the appropriate selection of materials to achieve this.

While the present invention is described in relation to a display device, the present invention is applicable to other forms of device which makes use of electroluminescence.

We claim:

1. An electroluminescent device comprising a film containing a phosphor and means for causing movement of electrons in said film, said means comprising a first layer on one side of said film and a second layer on the other side of said film wherein said film includes a first material which is also present in said first layer, the concentration of said first material in said film decreasing with distance from said first layer.

2. An electroluminescent device according to claim 1 wherein said film comprises a phosphor layer and an interface region between said first layer and the phosphor layer, the interface region comprising said first material and a second material which is also present in the phosphor layer.

3. An electroluminescent device according to claim 1, wherein the electroluminescent device is a capacitively-coupled electroluminescent device and said first layer comprises a dielectric layer adjacent said film and an electrode layer.

4. An electroluminescent device according to claim 1, wherein the electroluminescent device is a directly-coupled electroluminescent device and said first layer comprises an electrode layer.

5. An electroluminescent device according to claim 4 wherein the electrode layer comprises a layer of cadmium stannate, the phosphor comprises manganese-doped zinc sulphide and said first material is cadmium.

6. A method of manufacturing an electroluminescent display device, the method comprising the steps of:

providing a film and means for causing movement of electrons in said film, said means comprising a first layer on one side of said film and a second layer on the other side of said film, and said film comprising a phosphor;

and causing a first material to be present in both said film and said first layer such that the concentration of said first material in said film decreases with distance from said first layer.

7. A method according to claim 6 wherein said step of causing said first material to be present in both said film and said first layer comprises the steps of providing a phosphor layer and forming an interface region comprising said first material and a second material which is also present in the phosphor layer such that said interface region is positioned between the phosphor layer and said first layer.

8. A method according to claim 6 wherein said step of causing said first material to be present in both said film and said first layer comprises the step of providing a phosphor layer and effecting diffusion between the phosphor layer and said first layer.

9. A method according to claim 8 wherein the step of effecting diffusion comprises the step of providing a catalyst at the interface of the phosphor layer and said first layer.

10. A method according to claim 6 for manufacturing a capacitively-coupled electroluminescent device wherein said first layer comprises a dielectric layer located adjacent said film and an electrode layer.

11. A method according to claim 6 for manufacturing a directly-coupled electroluminescent device wherein said first layer is an electrode layer.

12. A method according to claim 8 for manufacturing a directly-coupled electroluminescent device wherein said first layer is an electrode layer.

13. A method according to claim 12 wherein the electrode layer comprises a layer of cadmium stannate, the phosphor comprises manganese-doped zinc sulphide and the catalyst comprises chromium and/or chromium oxide.

* * * * *